US006409430B1

(12) United States Patent
Shepherd

(10) Patent No.: US 6,409,430 B1
(45) Date of Patent: Jun. 25, 2002

(54) WELHEAD TEMPLATES

(75) Inventor: Paul M Shepherd, Aberdeen (GB)

(73) Assignee: Kvaerner Oilfield Products Limited, London (GB)

( * ) Notice: Subject to any disclaimer, the term of this patent is extended or adjusted under 35 U.S.C. 154(b) by 0 days.

(21) Appl. No.: 09/720,987

(22) PCT Filed: Jul. 1, 1999

(86) PCT No.: PCT/GB99/02084

§ 371 (c)(1),
(2), (4) Date: Jan. 25, 2001

(87) PCT Pub. No.: WO00/01923

PCT Pub. Date: Jan. 13, 2000

(30) Foreign Application Priority Data

Jul. 3, 1998 (GB) ..... 9814343

(51) Int. Cl.[7] ..... E21B 7/12; E21B 41/08

(52) U.S. Cl. ..... 405/195.1; 166/358; 166/366; 175/7; 175/9; 408/241 G

(58) Field of Search ..... 405/195.1, 224, 405/227, 228, 203, 209; 166/366, 358, 368; 408/241 G; 175/5, 7–9

(56) References Cited

U.S. PATENT DOCUMENTS

| | | | | |
|---|---|---|---|---|
| 4,126,008 A | | 11/1978 | Dixon | 405/207 |
| 4,147,036 A | * | 4/1979 | Worrell et al. | 405/205 |
| 4,540,314 A | * | 9/1985 | Falkner, Jr. | 405/227 |
| 4,669,918 A | * | 6/1987 | Riles | 405/227 |
| 5,040,607 A | * | 8/1991 | Cordeiro et al. | 166/366 |
| 5,150,987 A | * | 9/1992 | White et al. | 405/224 |
| 5,702,206 A | | 12/1997 | Quenan et al. | 405/227 |
| 5,722,796 A | | 3/1998 | Halvorsen et al. | 405/195.1 |

FOREIGN PATENT DOCUMENTS

| | | |
|---|---|---|
| EP | 0 293 251 | 11/1988 |
| EP | 0 494 497 | 7/1992 |
| GB | 2 003 532 | 3/1979 |
| GB | 2 202 257 | 9/1988 |
| WO | 96 06260 | 2/1996 |

* cited by examiner

*Primary Examiner*—Robert E. Pezzuto
*Assistant Examiner*—Tara L. Mayo
(74) *Attorney, Agent, or Firm*—Nixon & Vanderhye P.C.

(57) ABSTRACT

A drilling and production template for sub-sea wells comprises a plurality of individual limbs (1–4) each with a central hub (10–14) at one end of an arm (11–41) and a drilling receptable (12–42) on the other end of the arm. The hubs are of different diameters such that they fit within each other in a telescopic manner. They have cut-out (27, 37, 47) accommodate the arms of the other limbs when installed. The template may be deployed onto a pre-installed foundation with the arms stacked vertically above the other, in such manner as to pass through the moonpool of a drilling vessel. The complete assemblies are installed on a mechanical running tool attached to a drilling string. After the template is disposed on the foundation, the drilling string is rotated, causing the running tool to rotate the limbs (1–4) so that the hubs telescope into each other, providing a splayed multi-well drilling and production template.

12 Claims, 5 Drawing Sheets

WELHEAD TEMPLATES

FIELD OF THE INVENTION

This invention relates to templates for use sub-sea, that is to say at or adjacent the bottom of the sea or other body of water and intended to provide guides for the drilling of sub-sea wells for petroleum or other liquid or gaseous hydrocarbons and also to provide, preferably, a sub-sea frame for a manifold and other means by which hydrocarbons are extracted from the wells and hydraulic and other control lines are connected to the wellhead.

BACKGROUND TO THE INVENTION

It is customary to provide a wellhead template in the form of a rigid frame which includes several spaced-apart guides for drilling pipes. Such a template is deposited on or adjacent the sea bed in a desired location, with or without the aid of ancillary supports, and acts as at least an initial guide for drilling strings for up to the number of wells that can be be positionally defined by the template. It is customary for the multi-well template to support, during the extraction or production phase manifolds, 'Christmas trees' and other known equipment employed for the extraction of the liquid or gaseous hydrocarbons and the control of the process of extraction.

Known rigid templates as described in the foregoing exhibit several practical disadvantages. For example it is preferable to lower the template to the sea bed through an aperture in a drilling vessel known as a moonpool. Although moonpools are substantial in size, being typically rectangular of the order of 5 or 6 meters in breadth and 6 or 7 meters in length, they are, necessarily, limited in extent. On the other hand, it is often desirable to provide an inter-well spacing which should require, typically, a four-well template to be of the order of 20 meters by 20 meters. Although these figures are given only as typical examples, there is in any event a practical limitation on the size of a rigid template which can be deployed through a moonpool.

It is known to provide a multi-well template comprising relatively hinged parts so that the template can be deployed through the moonpool in a folded configuration and be subsequently unfolded to lie flat on or adjacent the sea bed. However, not a great increase in lateral extent can be achieved using a hinged template and deployment of it is inconvenient.

A further disadvantage of both rigid and hinged templates is their occupancy of space between the positions of the well. It is often desirable to provide additional satellite wells in the vicinity of the original drilling and it may be desirable to dispose those wells within a region generally bounded by the wells of the original template. However, with known rigid or hinged templates all subsidiary or subsequent wells must be disposed outside the general area of the template and there is therefore not only a constraint on the positioning of satellite wells but added complexity or difficulty in establishing fluid connections between the template manifold and the satellite wells.

It is known from GB-A-2003532 to provided a well template which has two 'scissor' arms each having a well guide at each end. The template is intended to float in a splayed condition.

The object of the invention is to provide an improved multi-well template. Although, as will be apparent the invention is more broadly defined hereinafter, a preferred drilling and production template for sub-sea wells in accordance with the invention comprises a plurality of individual limbs each comprising a hub connected by an arm to a drilling guide. The hub may be at one end of the arm and the drilling guide may be at the other end of the arm. The hubs or central supports are preferably of differing diameters so that they fit one within another in a 'telescopic' manner. The hubs have mutually engaging parts, preferably in the form of cut-outs or axial slots, which can accommodate the arms of other sections when they are installed. Such a template may be deployed onto a foundation from a drilling vessel with the limbs in a closed configuration and in particular with the arms stacked vertically above each other. In such a configuration the assembly may pass through the moonpool of the drilling vessel or platform. The assembly of limbs may be installed on a mechanical running tool attached to a drilling string. After the assembly lands on an appropriate foundation, the drilling string may be rotated to cause the running tool to rotate the limbs so that they fan out into a desired open configuration. The template preferable as indicated includes indexing slots which operate as the arms fan out so as to fix the arms in predetermined angular positions relative to each other. In particular, the slots ma be arranged so that as each arm is rotated relative to its neighbour it can enter the slot in the neighbour and close axially relative to the neighbour. Preferably the cut-outs or slots are arranged so that the hubs telescope into each other to provide the template with a configuration in which the arms radiate in approximately the same common plane. After the wells are drilled a suitable manifold may be installed on the centre of the structure.

Particular examples of the invention will be described in the following, with reference to the drawings.

DETAILED DESCRIPTION

Figure 1:
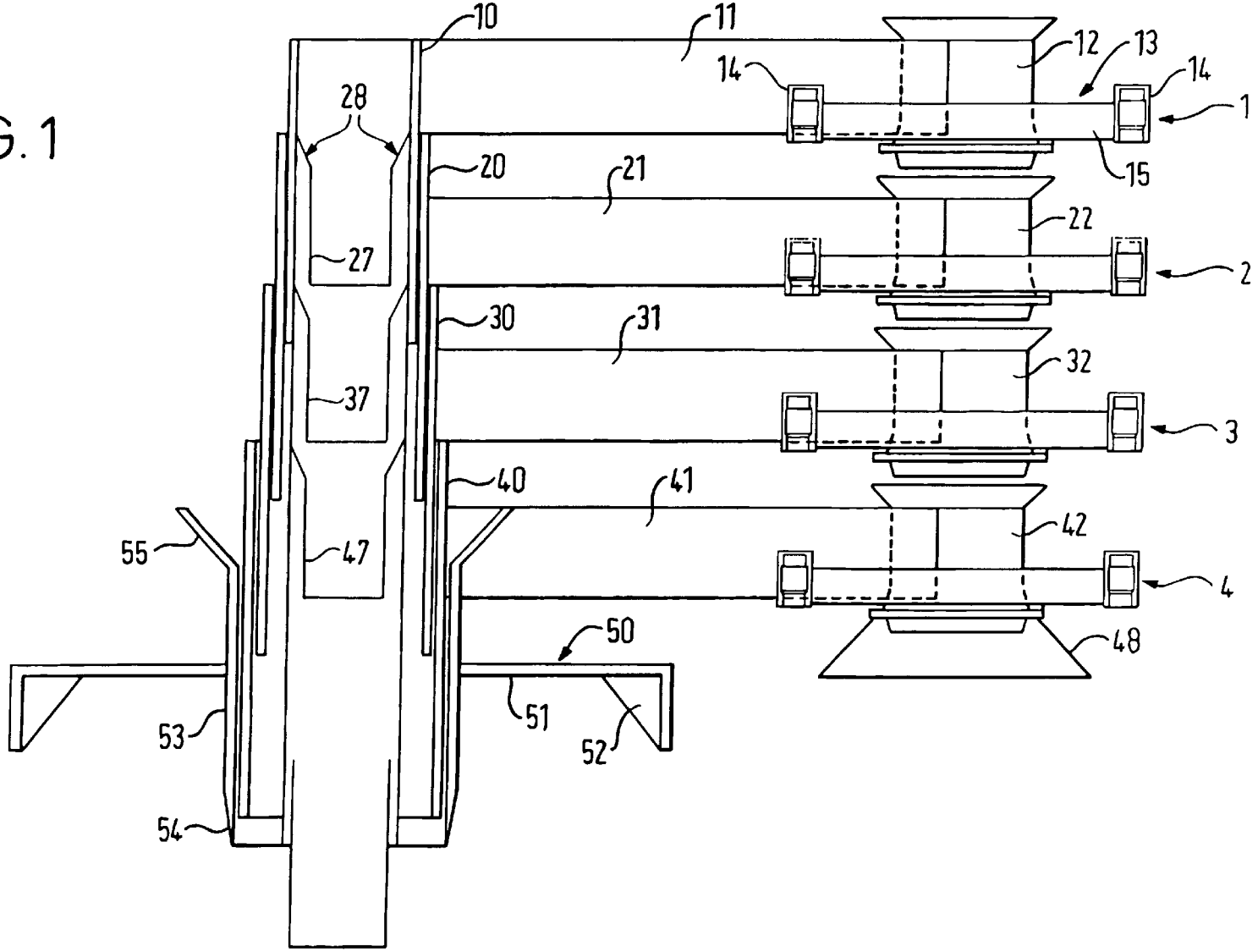
FIG. 1 illustrates one embodiment of the invention, in an initial configuration and deployed on a pre-installed sub-sea foundation.

FIG. 1 illustrates a rotary template according to the invention in a 'stacked' or initial configuration. For convenience the template is shown as deployed on a pre-installed sea-bed platform 50, as will be described later.

The template comprises a plurality of individual limbs. In this embodiment there are four limbs, intended to be finally deployed at right angles to each other. A different number of limbs, in particular from three to six inclusive, could be used.

The limbs are generally similar. A first limb 1 comprises a hub 10, which is preferably in the form of a cylindrical tubular support, an arm 11 which extends from the hub 10 laterally outwardly, and a drilling receptacle or guide 12. As illustrated, the hub 10 and the receptacle 12 are at opposite ends of the arm 11 but different arrangements are possible. It is normally desirable to maximize the distance between the hub 10 and the receptacle 12 for a given length of arm 11.

The receptacle 12 may be part of a guide base 13 containing receptacles 14 for guide posts and a structural framework 15 including braces 16 (not shown in FIG. 1).

The second limb 2 comprises a hub 20, an arm 21 and a drilling receptacle 92. The arm 21 resembles the arm 11 and the receptacle or guide 22 resembles guide 12. Hub 20 is a cylindrical support tube which is slightly larger than the tube constituting hub 10 so that hub 10 fits within and is rotatable relative to hub 20. Furthermore, hub 20 has a cut-out 27 defining an axial slot which is wide enough to accommodate the arm 11 whereby when arm 11 is rotated relative to arm 21, arm 11 will reach a position wherein it can drop into the slot 27 and be thereby indexed in a fixed angular position relative to arm 21. The upper edges of the slot are outwardly flared at 28 to facilitate the entry of the arm into slot 27.

The third limb 3 has a hub 30, which is again a cylindrical support tube within which the hub 20 can rotate, an arm 31 resembling arms 11 and 21 and a drilling receptacle 32 resembling receptacles 12 and 22. The hub 30 has slots, of which only one slot 37 is shown. Each of these slots resembles slot 27. These slots in hub 30 can accommodate arms 11 and 21 so that these arms will be in a fixed angular position relative to arm 31 when arms 11 and 21 have been rotated to enable the arms to drop into the respective slots in hub 30.

Correspondingly, the fourth limb 4 has a hub 40 with slots, of which only slot 47 is shown, for the accommodation of arms 11, 21 and 31 whereby, for the particular embodiment, when arm 11 has been rotated through 270 degrees from the initial stacked position all the hubs are telescoped together and the arms 11, 21, 31 and 41 are fanned out at right angles to each other in a rigid configuration, the arms being in substantially the same rotary plane. Arm 41 resembles the other arms 11, 21 and 31 and receptacle 42 resembles receptacles 12, 22 and 32. However, receptacle 42 may have a splayed foot 48 since it will be the lowermost and the foot may be required to rest on the sea bed.

Also shown in FIG. 1 is a pre-installed foundation 50 comprising a base plate 51, stabilising feet 52 and a receiving pipe 53 which tapers to a sharp edge at its lower extremity 54 and is flared at its upper extremity 55 so that the lowermost hub 40 can easily enter the pipe 53 notwithstanding initial misalignment.

A template as described has several practical advantages. It is simple to fabricate. It can be assembled in a moonpool as explained below and a simple running tool can be used for both installation and deployment.

The deployment of the template will be described with the aid of FIGS. 2 and 3.

A normal preliminary to the deployment of the template is the provision of a foundation, which will be engaged by, and will serve to support, the telescoped hubs of the template. The foundation may be a drilled 30 inch (760 millimeter) conductor, a drilled 60 inch (1512 millimeter) pile, a 'mud-mat' or any combination which will suit the conditions of the soil. The foundation shown in FIG. 1 is an ordinary mud-mat.

The individual limbs 1 to 4 may be lifted onto the production rig either as individual units or in pairs, depending on their size and weight. The individual arms may be 'skidded' into the moonpool and stacked, in a configuration as shown in FIG. 1. A running tool, with a suitable drill pipe attachment device is engaged in a lifting connection and the assembly may be run down to the sub-sea location on the drill pipe into the pre-installed foundation. The running tool will be disengaged from the lifting connection and caused to enter the hubs. The running tool will be used to rotate the hubs so that the topmost limb will rotate (in this example) 270 degrees. As the arms in each limb reach a position over the respective slot in the adjacent lower arm, the arms will drop into their slots so that the hubs telescope together.

Figure 2:
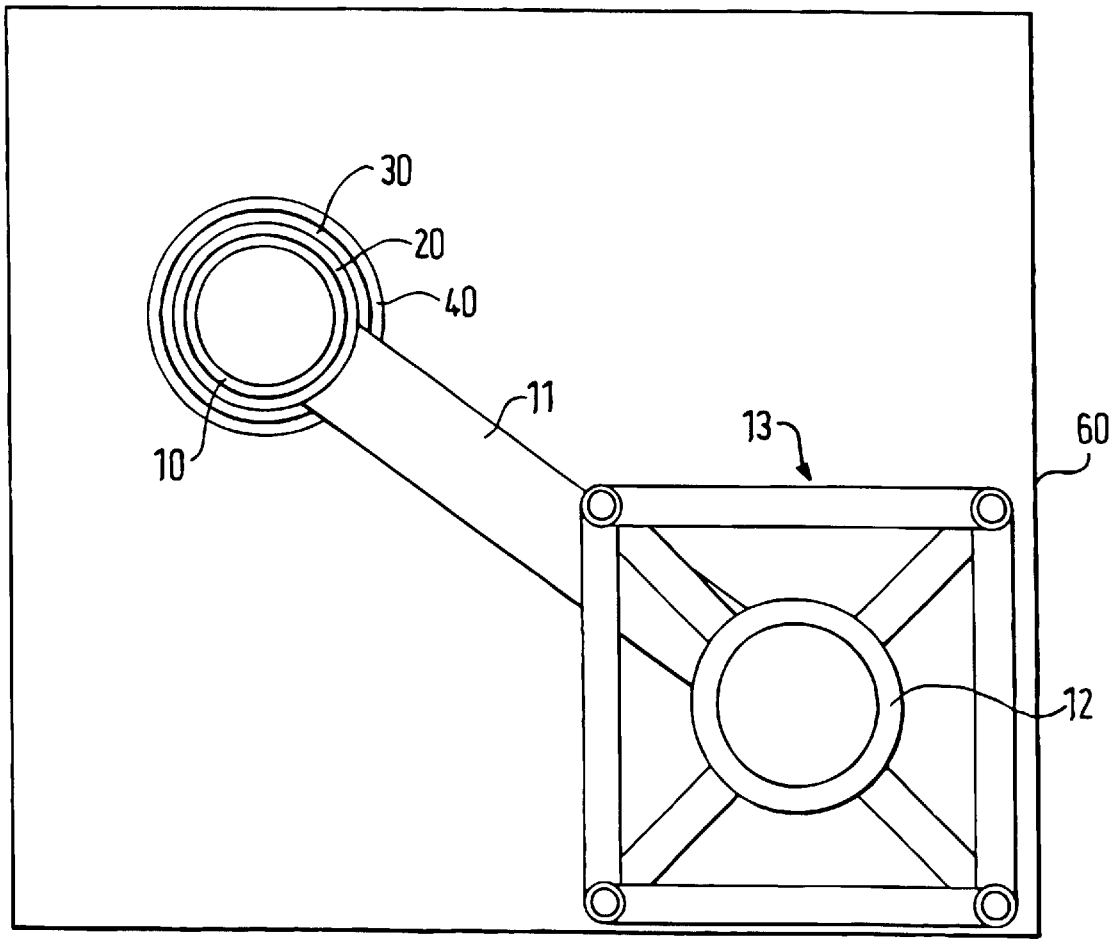
FIG. 2 illustrates the template in relation to a typical moonpool.

FIG. 2 illustrates the limbs of the rotary template in a stacked configuration in relation to a moonpool 60. Only the uppermost arm 11 is shown. As may be seen, the moonpool can accommodate a stacked template of which the effective or overall length of the limbs occupies most of a diagonal dimension of the moonpool 60.

Figure 3:
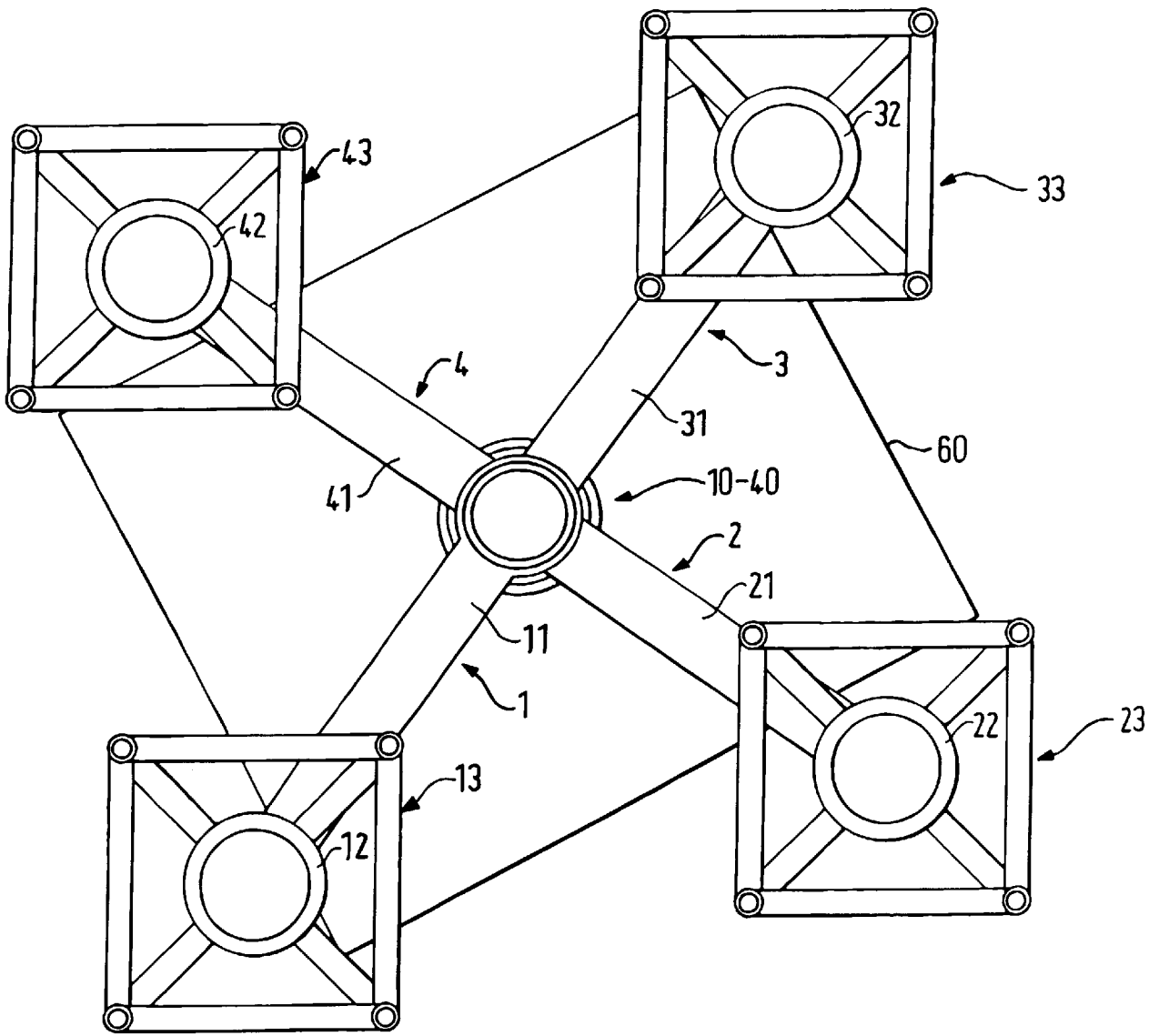
FIG. 3 illustrates the template in an open or final configuration.

FIG. 3 illustrates the template in its open or fanned-out configuration, with adjacent arms of arms 11, 21, 31 and 41 being set at right angles to each other. Guide bases 23, 33 and 43 on respective arms 21, 31 and 41 correspond to guide base 13 on arm 11. The moonpool is shown by the superimposed rectangle 60. In the splayed configuration the distance between at least two of the guides (and in this embodiment the respective distance between any two guides) is substantially greater than the length of any of the arms.

The running-tool may be disengaged and recovered the wells will be drilled through the guide plate receptacles either partially or completely.

Figure 4:
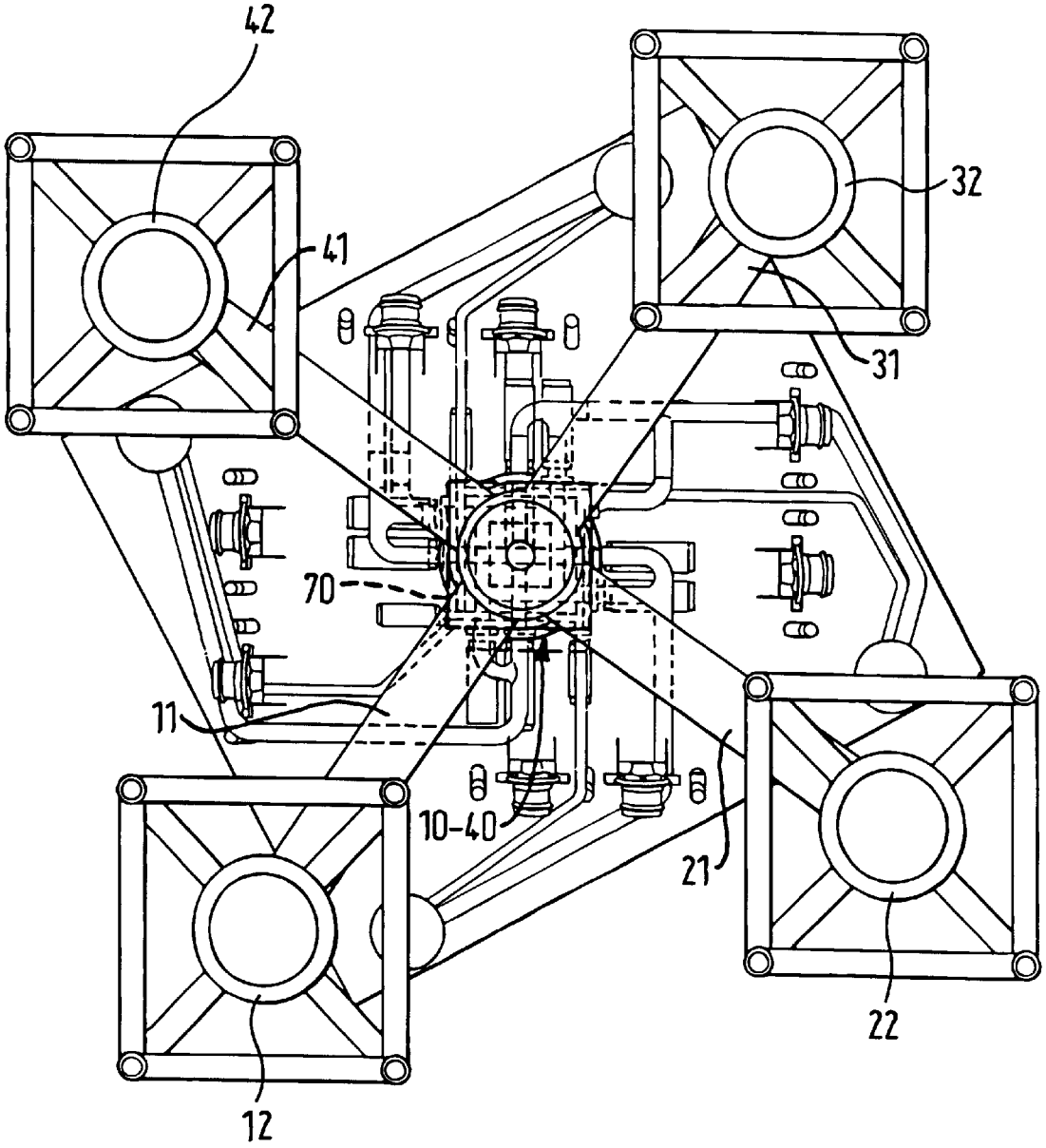
FIG. 4 illustrates the template and a typical manifold and ancillary equipment.

A typical next stage is the assembly of a manifold onto the template. FIG. 4 illustrates the four arms 11, 21, 31 and 41 extending from the hubs 10, 20, 30 and 40 to the receptacles 12, 22,32 and 42 and a manifold assembly comprising a central manifold block 70 located on the hubs. The manifold assembly may be adapted to index to the hub 10. Further assembly may take place in known manner, including the disposition of 'Christmas trees', the making up of flow line connections in the normal vertical manner, and the completion of control connections.

Figure 5:
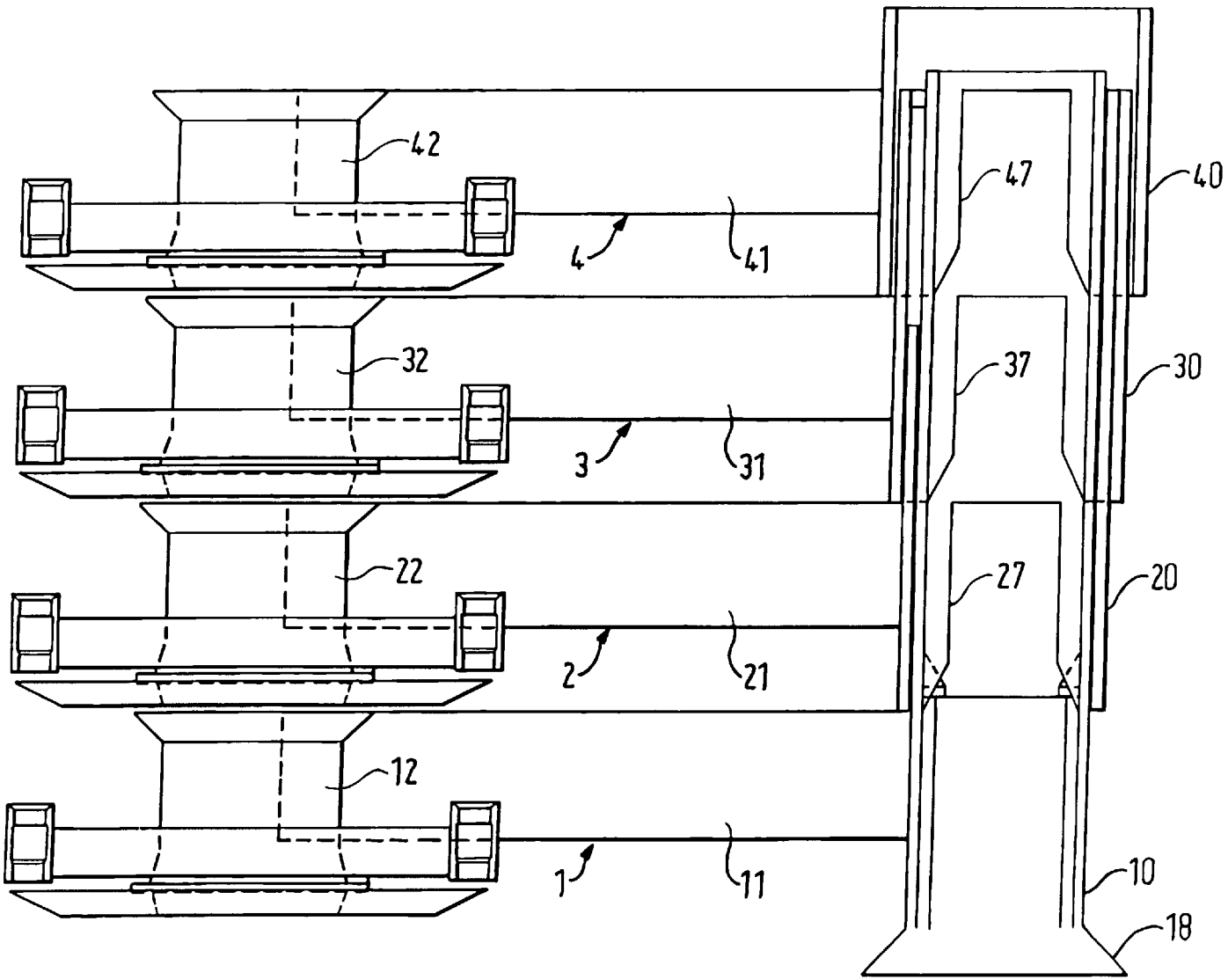
FIG. 5 illustrates the template in an inverted configuration.

FIG. 5 illustrates a similar embodiment to that shown in FIG. 1, shown in an inverted manner wherein the hub 40 is uppermost and the lowermost hub 10 has a foot 18 for resting on the sea floor. This embodiment is otherwise very similar to that shown in FIG. 1 and it may be deployed in a similar manner. The hub 40 will be rotated and the slots 27, 37, 47 etc will drop onto the arms 11, 21 and 31 in a manner corresponding to that described with reference to FIG. 1.

What is claimed is:

1. A sub-sea well template comprising a plurality of limbs (1–4) each of which comprises an arm (11–41) having a hub (10–40) at one end and a drilling guide (12–42) at the other end, the hubs fitting one within another for rotation about a common axis and the limbs being mutually rotatable from a configuration wherein the arms are close together to a configuration in which the arms are widely splayed.

2. A template according to claim 1 and further comprising means (27, 37, 47) for indexing the arms in the splayed configuration.

3. A template according to claim 2 wherein the indexing means (27, 37, 47) comprise slots in the hubs disposed such that as the limbs rotate, at least one of said arms can enter a respective slot in at least one of said hubs and be thereby retained in fixed angular position.

4. A template according to claim 3 wherein each hub (10–40) comprises a cylindrical pipe.

5. A template according to claim 4 wherein the slots (27, 37, 47) are open-ended slots in respective hubs.

6. A sub-sea well template comprising a plurality of limbs (1–4) each of which includes an arm (11–41) connecting a respective hub (10–40) and a respective drilling guide (12–42), the hubs fitting together for rotation about a common axis, and the limbs being mutually rotatable from a first configuration wherein the arms (11–41) are close together to a second configuration in which the arms are widely splayed, the distance between at least two of the drilling guides (12–42) in the second, splayed configuration being substantially greater than the overall length of any of the arms.

7. A template according to claim 6 wherein the arms (11–41) are stacked one above another in the first configuration.

8. A template according to claim 6 wherein the hubs include indexing slots (27,37,47) each of which can receive one of the arms, whereby the arms can be retained in fixed angular positions.

9. A sub-sea well template comprising a plurality of limbs (1–4) each of which includes a respective hub (10–40) and a drilling guide (12–42) connected by a respective arm (11–41), wherein the limbs fit together for rotation about a common axis and the limbs are mutually rotatable from a first configuration in which the arms (11–41 ) are close together to a second configuration in which the arms are widely splayed, the hubs (10–40) including indexing slots (27, 37, 47) each of which can accommodate at least one of the arms as the arms are rotated to the slaved condition whereby the arms are held by the slots in relatively fixed angular positions.

10. A template according to claim 9 wherein the slots (27, 37, 47) are disposed so that the hubs (10–40) telescope into each other whereby the arms (11–41) radiate in approximately the same plane.

11. A template according to claim 9 wherein said limbs comprise at least first, second and third limbs and wherein the respective hub of said second limb has an indexing slot which accommodates the arm of the first limb and the respective hub of the third limb has two indexing slots which accommodate one each of the arms of the first and second limbs.

12. A template according to claim 11 wherein said limbs include a fourth limb of which the respective hub has three indexing slots which accommodate a respective one each of the arms of the first, second and third limbs.

* * * * *